United States Patent [19]

Makarenko

[11] Patent Number: 4,948,158

[45] **Date of Patent: * Aug. 14, 1990**

[54] SKI BINDING

[76] Inventor: Vladimir S. Makarenko, prospekt Kultury, II, korpus I, kv. 279, Leningrad, U.S.S.R.

[ * ] Notice: The portion of the term of this patent subsequent to Jun. 7, 2005 has been disclaimed.

[21] Appl. No.: 325,047

[22] Filed: Mar. 14, 1989

Related U.S. Application Data

[63] Continuation of Ser. No. 23,120, filed as PCT SU86/00031 on Apr. 24, 1986, published as WO86/06288 on Nov. 6, 1986, abandoned.

[30] Foreign Application Priority Data

Apr. 24, 1985 [SU] U.S.S.R. ..... 3878643

[51] Int. Cl.[5] ..... A63C 9/18

[52] U.S. Cl. ..... 280/615

[58] Field of Search ..... 280/613, 614, 615, 623, 280/625

[56] References Cited

U.S. PATENT DOCUMENTS

| | | | |
|---|---|---|---|
| 3,603,606 | 9/1971 | Eie | 280/615 |
| 3,947,053 | 3/1976 | Sittmann | 280/623 |
| 3,979,131 | 9/1976 | Ginther | 280/615 |
| 4,023,824 | 5/1977 | von Besser | 280/623 X |
| 4,098,522 | 7/1978 | Beyl | 280/623 X |
| 4,146,247 | 3/1979 | Johansson et al. | 280/615 |
| 4,487,427 | 12/1984 | Salomon | 280/615 |
| 4,749,208 | 6/1988 | Makarenko | 280/615 |

FOREIGN PATENT DOCUMENTS

| | | | |
|---|---|---|---|
| 607720 | 11/1960 | Canada . | |
| 1221121 | 7/1966 | Fed. Rep. of Germany . | |
| 2365630 | 9/1975 | Fed. Rep. of Germany . | |
| 2805514 | 8/1979 | Fed. Rep. of Germany | 280/615 |
| 3240750A | 5/1984 | Fed. Rep. of Germany . | |
| 2264572 | 3/1974 | France . | |
| 37163 | 4/1923 | Norway . | |
| 8606289 | 11/1986 | PCT Int'l Appl. . | |
| 8606291 | 11/1986 | PCT Int'l Appl. . | |
| 719643 | 3/1980 | U.S.S.R. . | |

*Primary Examiner*—Charles A. Marmor
*Assistant Examiner*—Tamara L. Finlay
*Attorney, Agent, or Firm*—Burgess, Ryan and Wayne

[57] ABSTRACT

A ski binding comprises rest pins (1) mounted on a ski (2) for fitting in corresponding holes (4) in a boot sole (5) toe and a lock restraining the boot vertical movement designed as a blade bracket-shaped spring (3), one end thereof being rigidly attached to the ski (2). The spring (3) has a stop limiting vertical movement of its free end, which is designed as a recess (8) in the front surface of the boot sole (5) toe, a plate mounted on the welt of the boot sole toe, a hinged bail, a plate mounted on the spring, a flange disposed on the boot sole toe, or a tenon on the spring.

7 Claims, 5 Drawing Sheets

SKI BINDING

This application is a continuation of application Ser. No. 023,120, filed as PCT SU86/00031 on Apr. 24, 1986, published as WO86/06288 on Nov. 6, 1986, now abandoned.

FIELD OF THE INVENTION

The invention relates to sporting gear, and more specifically, to ski binding for cross-country skis.

The invention may be used both for sporting cross-country skis and for touring cross-country skiing.

The present invention may be used to the best advantage with ski boots that have no elements projecting beyond the boot itself in the toe part of the sole.

BACKGROUND OF THE INVENTION

Today we witness the dramatic growth and changes of the standards that the sporting gear must meet. As skating motion is gaining popularity, it has become necessary to enhance the ski boot sole resistance to twisting, because in this way the skier over a long period of time runs on the ski edge. In this case the sliding surface of the ski (and the boot sole surface as well) forms a substantial angle with the surface of the ski-truck (snow or snow-crust) bringing about strong twisting moments with respect to the boot sole when the skier pushes.

At present an "Adidas" ski binding is widely used, that consists of a plate with side-frames set at an angle to the longitudinal axis of the ski. The plate size and the value of the side-frames slope are determined by the size and shape of the boot sole toe complying with the "Racing Norm 38". The binding is designed for use with a ski boot that has a flange on the upper surface of the boot sole toe. The binding lock is designed in the following way. The plate carries a pin to which a lever is fixed that has still another pin at its free end. To this latter pin a second lever is fixed, the free end thereof holding down the flange of the boot sole toe. To lock the boot a skier must rest the end of the second lever against the boot flange and press the first lever which in this case keeps turning until the line connecting the two pins becomes lower than the line connecting the first pin with the rest point. To this position the boot gets locked. A high reliability of the design is one of the advantages of the latest modifications of the binding. Disadvantages of said binding include its considerable weight, relatively low adaptability to manufacture, relative complexity of the lock design, the necessity of using hands (ski poles) to lock or unlock the boot and considerable torques in the horizontal plane of the boot sole, the latter disadvantage being especially serious when a skating motion is used. Strong sole twisting is caused not only by the binding design but also by a narrow sole toe of a standard "Racing Norm 33" type boot which has a narrower toe as compared to the "Racing Norm 50" boot.

A ski binding of the "Rotafella" type widely used. This binding also consists of a plate with side-frames set at an angle to the longitudinal axis of the ski. As distinct from the "Adidas" binding, it has got three pins directly on the plate, which mate with the corresponding holes in the boot sole toe. The boot is locked with a shackle, free ends of which are set in sleeves of side-frames. In the foremost part of the binding there is an axle carrying a notched plate. The boot is placed in such a way that the holes in the boot sole toe mate with the pins. Then the skier presses the shackle into engagement with one of the notches in the plate. The binding may have different types of locks. For example, locks with eccentrics are widely used of late. Secure boot locking and a smaller torque occurring in the plane perpendicular to the ski longitudinal axis as compared to the "Adidas" binding mentioned above may be cited as advantage of said binding. Disadvantages include its considerable weight, relatively low adaptability of the binding and the lock to manufacture and, in particular, the necessity to use hands (poles) when locking and unlocking the boot.

There is a prior art ski binding which consists of rest pins, of two parts each, and a lock that restrains the boot vertical movement (cf. FRG Patent Application as published for opposition No. 3240750). One part of the pin is directly fixed in the ski (boot) and body, the other part fits in the corresponding boot sole (ski) hole. If the bottom part of the pin is fixed in the ski body, then, in order to lock the boot it is necessary to place it so that upper parts of the pins fit in the corresponding holes in the boot sole toe. To restrain the boot vertical movement various locks are employed. Advantages of said binding include relatively high adaptability to manufacture and simple design, its quick mounting and dismantling, use of different types of locks. Disadvantages include relatively poor functional qualities of the binding when locking and unlocking the boot because this can be done only manually.

A prior art binding (cf. FRG Patent No. G 8425984.1) comprises ski-mounted rest pins for mating with corresponding holes in the boot sole toe and a lock featured as a bracket-shaped blade spring for straddling from above the boot sole toe and having one end attached to the ski. High adaptability to manufacture, low production cost, small overall dimensions, light weight, automatic (no need to use hands) locking of the boot to the ski may be cited among its advantages. But this binding may be used only with ski boots that have a projecting sole toe or a welt. Accordingly, if a horizontal component force perpendicular to the ski longitudinal axis occur when the skier pushes, then a substantial torque is developed, as the skier's push zone does not coincide with the boot lock zone. Said disadvantage is characteristic of all types of binding designed for use with ski boots with a projecting toe and is most clearly manifested when skating motion is used.

Another serious disadvantage of said binding is that the lock in this design is adopted to a welt of a fixed thickness. The lock has proved to perform satisfactorily provided that the welt thickness does not deviate from the design value for more than 2 mm either way. This lock does not allow the use of the same binding with ski boots having substantially different welt thickness which is today characteristic of all widely used locks in bindings of various designs. Besides, said locks are intended for use with boots having a welt or a forwardly extended portion of the sole toe.

SUMMARY OF THE INVENTION

The invention is directed to the provision of a ski binding that would have a lock element ensuring a reliable limitation of boot vertical movement both for boots having a sole toe projecting beyond the boot and without it.

The essence of the invention is that in a ski binding comprising rest pins mounted on a ski for mating with corresponding holes in the boot toe and a lock restraining the boot vertical movement and designed as a blade bracket-shaped spring, the spring according to the invention, is provided with a stop limiting the vertical movement of its free end movement.

Said design of the ski binding provides for secure locking of the boot irrespective of the fact whether or not it has got a sole toe projecting beyond the boot and irrespective of its shape.

The problem is solved by using a stop that limits the movement of the free end of the bracket-shaped spring, which stop can be mounted in any part of the boot sole toe or on the ski. Said binding design is more reliable as compared to prior art designs for locking boots with projecting sole toe, because, according to the proposed design basically intended for boots without a projecting sole toe the skier's pushing zone practically coincides with the boot pin locking zone, thus reducing breaking torques adding on the pins and contacting areas of the boot and the ski. This, in its turn, results in lesser sole twisting which is of special importance when skating movement is used. High boot sole rigidity permits using resilent properties of the material of the lock for locking the boot in the binding.

Introduction of a stop provides for a more reliable boot locking because the free end of the bracket-shaped spring works rather in fracture then in bending.

It is strongly recommended that the stop be shaped as a recess in the boot sole toe for locking the free end of the spring the other end thereof being fastened to the ski. Such a design of the binding not only provides for high adaptability to manufacture of the stop limiting the spring free end vertical movement but also permits the boot binding to be used with soles of varying thickness, that do not extend beyond the boot. It is only necessary that the recess and the free end of the lock be placed at equal distances from the upper surface of the ski.

It is practicable that the stop be implemented as a U-shaped plate mounted on the boot sole toe welt. A stop so designed may also be used with ski boots having a projecting boot sole toe or a welt. Said stop provides for the most secure locking of the free end of the spring, preventing it from moving upwards, thus ensuring reliable locking of the boot to the ski. The stop being so designed, the lock will be working in fracture, which makes the unlocking of the binding virtually impossible unless some mechanical breakdown of the lock be involved. In practice, it is always possible to avoid such a breakdown by proper choice of the material and cross-section of the free end of the lock. Additional advantages may be provided by making the stop removable.

According to one embodiment of the invention the stop may be designed as a bail, one end thereof being hingeably attached to the ski while the other is intended to straddle the free end of the spring from above. In this case the spring may be designed in such a way that the free end thereof could be relatively easily bent, thus permitting to move it so that it will embrace the sole (or its part). When the bail is thrown on, the free end of the spring cannot shift upwards. The use of said stop makes the locking of the boot considerably easier.

In the preferred embodiment of the invention the stop is designed as a rigid bracket-shaped plate mounted on a spring so as to move freely against it. Such a design of the lock allows the skier to decide whether to use the stop or not. Most expedient is to use the stop of said design to increase the boot locking reliability when completing.

It is practicable to design this stop as a flange located at the foremost end of the boot sole. Said stop is highly adaptable to manufacture, it provides for reliable locking of the spring free end and makes it possible for the skier to adjust the force of restraining the spring free end movement.

Some of the embodiments mentioned above make it possible to use standard boots of the "Racing Norm 50" type.

It is expedient to design the stop as tenons mounted on the spring surface facing the front surface of the sole. The stop of said design is very practicable to use with boot soles made of rubber. This kind of boots is very popular with tourists. In this case it is practically always possible to lock the boot no matter now thick the sole is.

BRIEF DESCRIPTION OF THE DRAWINGS

Other objects and advantages of the present invention will become clear from the following description of specific embodiments thereof with reference to the accompanying drawings, in which.

BEST MODE OF CARRYING OUT THE INVENTION

Figure 1:
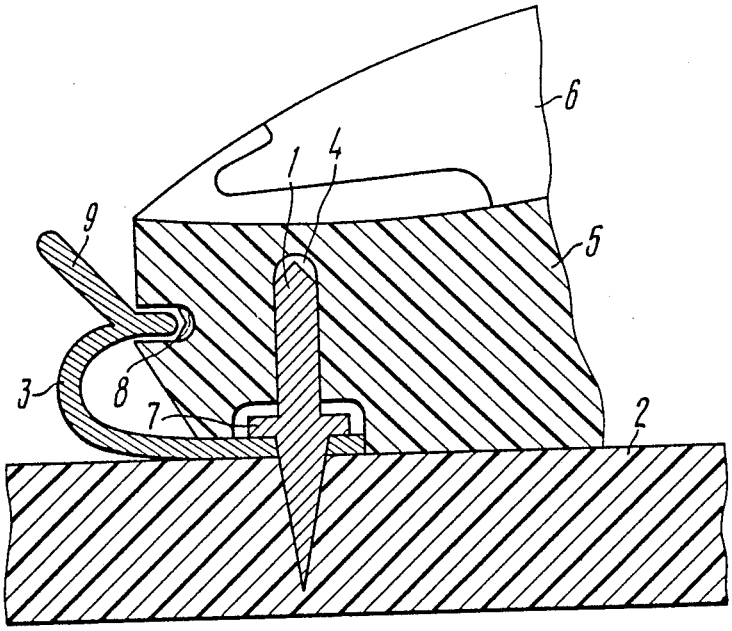
FIG. 1 represents the locking of the boot in the ski binding, according to the invention (longitudinal section)

The binding comprises rest pins 1 (FIG. 1) mounted on a ski 2 and a lock designed as a blade bracket-shaped spring 3, one end thereof being attached to the ski 2.

To provide for easier mounting and dismantling of the binding a rest pin 1 consists of two parts. The bottom part of the pin is fastened in the ski body 2 and its stop part mates with holes 4 in the sole 5 of the ski boot 6. The top and bottom parts of the pin 1 for mounting a spring 3 on the ski 2 may be divided by a support 7.

The spring 3 is provided with a stop limiting its free end vertical movement which may be designed as a recess 8 in the front surface of the sole 5 of the boot 6. A projecting part 9 of the spring 3 is designed for engaging and disengaging the recess 8 of the sole 5 with the free end of the spring 3. The front surface of the toe of the sole 5 of the boot 6 has a bevel in its lower part to provide for easier insertion of the shoe 6 into the ski binding.

The ski binding operates as follows.

For automatic locking (without using hand or a ski pole) of the boot 6 it is necessary to align the vertical axes of rest pins 1 with the axes of holes 4 in the sole 5 of the boot 6. Due to the bevel on the lower surface of the sole 5 of the boot 6 when the lower surface of the sole 5 of the boot 6 presses the free end of the bracket-shaped spring 3 a force occurs that acts on the free end of the spring 3 pressing the spring 3 out of its initial position thereby vacating space for mating the holes 4 of the sole 5 with the pins 1.

The pins 1 being inserted in the holes 4 of the sole 5, the free end of the spring 3 returns to its initial position, thereby engaging the recess 8 of the sole 5. Naturally, the size of the free end of the spring 3 matches the size of the recess 8.

For manual unlocking of the boot 6 it is necessary to apply force using a hand or a ski-pole to the section 9 of the spring 3 and to bend it so that the free ends thereof completely disengage the recess 8.

The ski binding may provide not only for automatic boot locking but also for automatic (skier need not use his hands) unlocking. In this case the recess 8 is placed in the sole 5 in such a way that the corresponding free end of the spring 3 enter the recess 8 upwards. Said ski binding provides for automatic unlocking also in the case when the free end of the spring 3 enters the recess 8 which is arranged either horizontally or at small angles with the surface of the sole 5. The possibility of automatic unlocking is provided by structural dimensions of the bracket-shaped spring 3 and the recess 8 and by their relative position.

For automatic unlocking of the boot 6 it is necessary, while resting the heel of the boot 6 against the ski, to apply the force of the foot to the toe of the sole 5 of the boot 6 trying to move it strictly upwards along the axes of the rest pins 1. In this case due to resilient properties of the material of the spring 3 the free end thereof gets out of the recess 8 under the action of the force applied to it from the lower surface of the recess 8.

Figure 2:
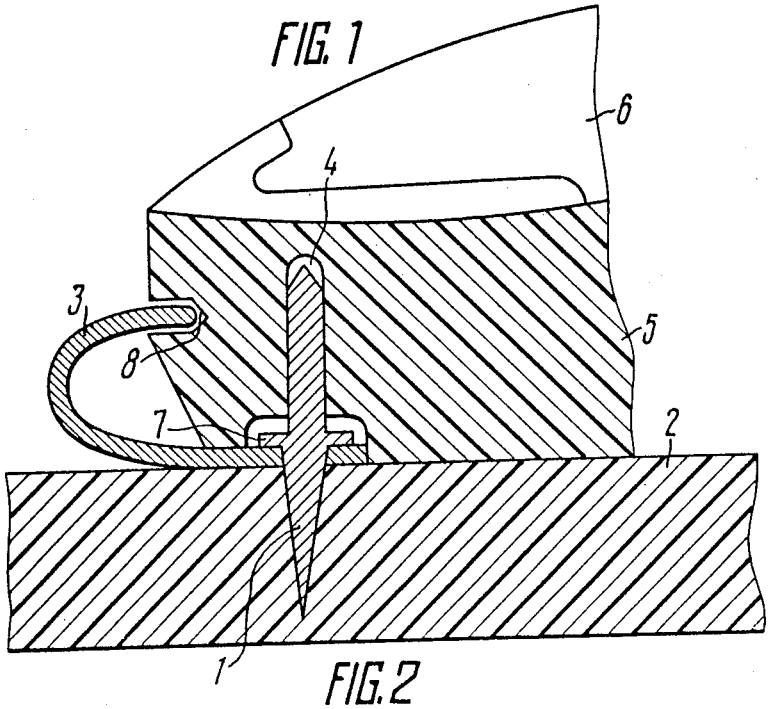
FIG. 2 is an embodiment of the ski binding, according to the invention (longitudinal section)

According to one embodiment of the invention, the spring 3 (FIG. 2) may be designed without the section 9.

Figure 3:
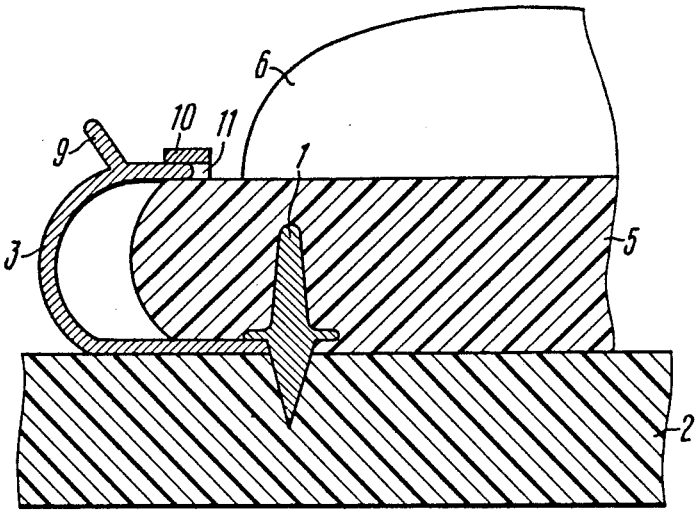
FIG. 3 shows the locking of the boot in the ski binding, according to the invention, wherein the stop is designed as a U-shaped plate (longitudinal section)
Figure 4:
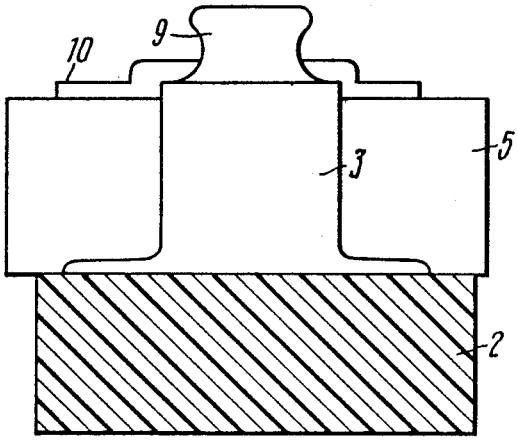
FIG. 4—the same (cross-section)

When the ski boot 6 has a welt the stop may be designed as a U-shaped plate (FIGS. 3, 4), mounted on the toe welt of the sole 5 of the boot 6. The plate 10 may be made of metal and attached to the welt of the boot 6 by fasteners (not shown).

The binding containing said stop operates as follows. The part 9 of spring 3 being pressed, the free end thereof is bent in the direction of the toe of the ski 2, making space for locking the sole 5 with the rest pins 1. After the sole 5 of the boot 6 is placed on the ski 2 with its lower surface, it is necessary to release the section 9 so that the free end of the spring 3 enters the opening 11 formed by the plate 10 and the upper surface of the sole 5 of the boot 6.

To unlock the boot 6, it is necessary to withdraw the free end of the spring 3 out of the opening 11 and then, forcing the boot 6 vertically upwards, disengage it from the pins 1.

Figure 5:
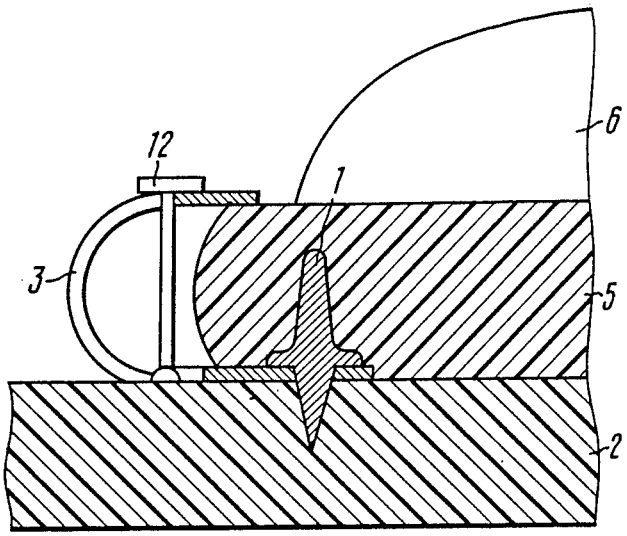
FIG. 5 shows the locking of the boot in the ski binding, according to the invention, wherein the stop is designed as a bail (longitudinal section)

In accordance with one embodiment of the invention, the stop limiting the vertical movement of the free end of the spring 3 may be designed as a bail 12 (FIG. 5), e.g. having an L-shape, hingeably attached to the ski 2 or the spring 3 (FIG. 5).

Said binding operates as follows. The free end of the spring 3 is swung towards the toe of the ski 2 so that the rest pins 1 can fit in the hole 4 of the sole 5 of the boot 6 after which the force is taken off the spring 3 that forces itself to the initial position. In this way it either straddles the welt of the sole 5 of the boot 6 from above (FIG. 5) or engages the recess 8 on the front surface of the toe of the sole 5 of the boot 6. After that the bail 12 starts rotating about the axis so that it passes from above over the surface of the spring 3 close to the free end thereof.

Figure 6:
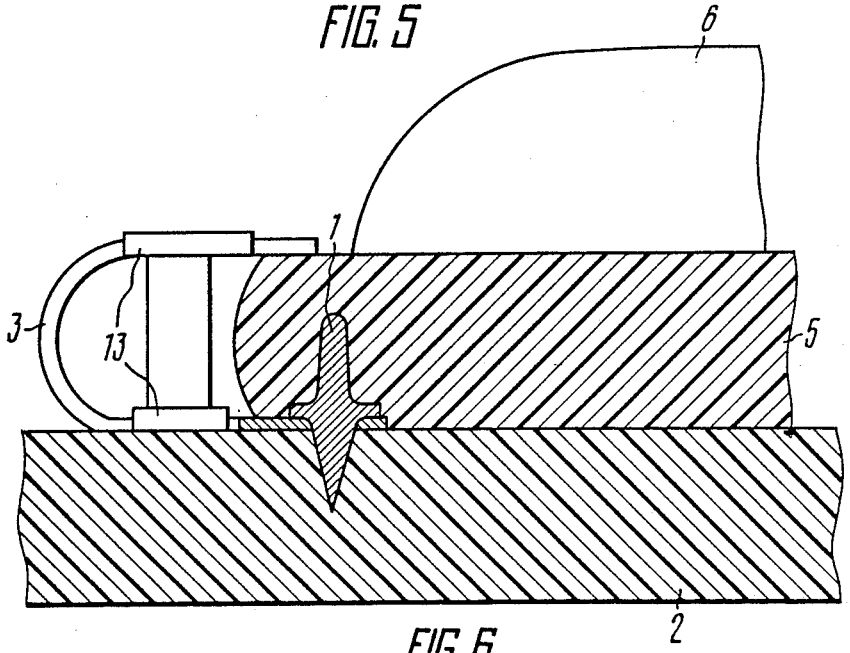
FIG. 6 shows the locking of the boot in the ski binding, according to the invention, wherein the stop is designed as two rigidly-coupled plates (longitudinal section)

The stop may be designed as a rigid bracket-shaped plate 13 mounted on the spring 3 so as to be able to move against it (FIG. 6). The stop of said type may be specifically designed as a rigid profile of four rectangular plates 13. The stop may be mounted on the front part of the spring 3 pressing the two surfaces of the spring 3 against each other. It may hold onto the lock due to resilient properties of the latter. The stop being removable makes it possible if necessary to use stops providing for various locking rigidity depending on the distance between the two plates 13 which are essentially parallel to the surface of the ski 2.

Figure 7:
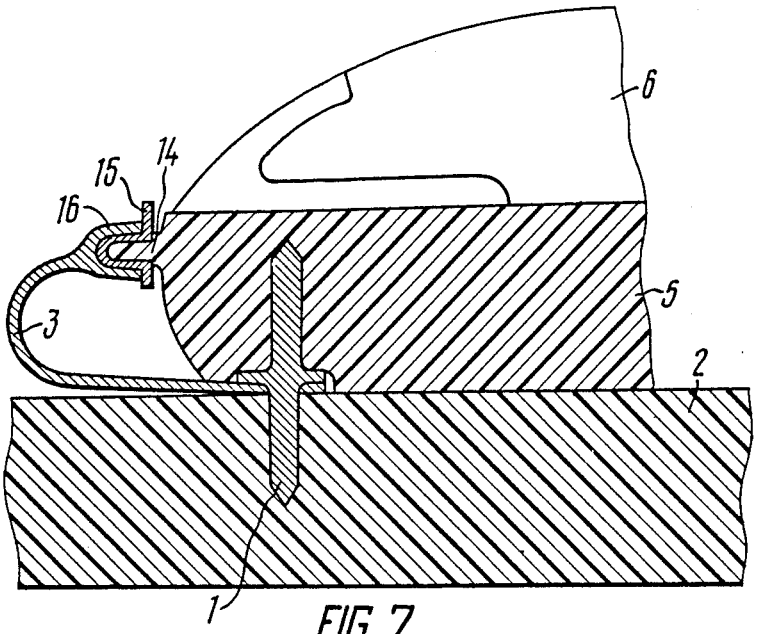
FIG. 7 shows the locking of the boot in the ski binding, according to the invention, wherein the stop is designed as a flange of the boot sole front surface (longitudinal section)

The stop may be designed as a flange 14 (FIG. 7) on the toe front surface of the sole 5 of the boot 6. The flange 14 is threaded to provide for the travel of the stopping bushing 15 for adjusting the clamping force of the spring 3. The free end of the spring 3 has a cavity 16 for enclosing the bushing 15.

To lock the boot 6 it is expedient to shift the stopping bushing 15 to the extreme position where it maximally engages the flange 14. After that it is necessary to bend the free end of the spring 3 by hand towards the toe of the ski 2 so that the sole 5 of the boot 6 could be locked with the rest pins 1. Then it is necessary to release the spring 3 which, forcing itself back, encloses the bushing 15 in the cavity 16. To increase the force pressing the boot 6 to the ski 2, it is necessary to turn the bushing 15 along the axis making it travel towards the toe of the ski 2. The bushing 15 is kept from travelling along the thread by the force acting on it from the direction of the lock.

Figure 8:
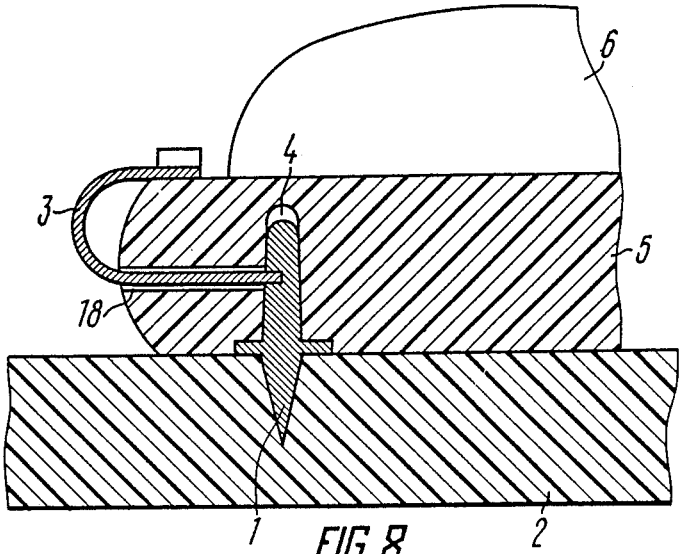
FIG. 8 shows the locking of the boot in the ski binding, according to the invention, wherein the lock is fastened to the boot sole (longitudinal section)
Figure 9:
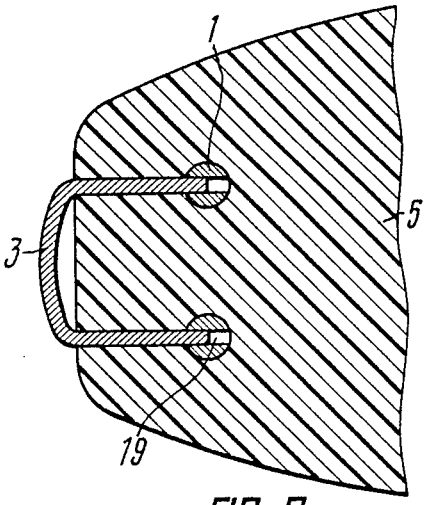
FIG. 9 represents a section in FIG. 8.
Figure 10:
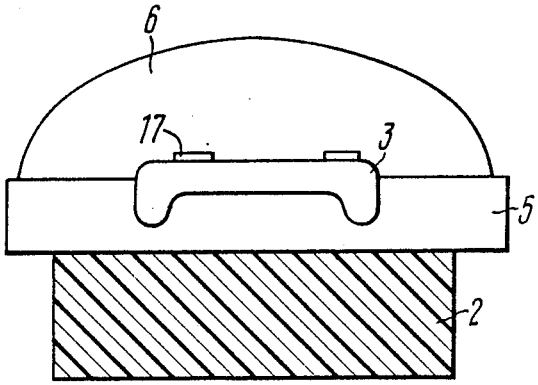
FIG. 10 is the same (cross-section)

The spring 3 may be attached at its one end with fasteners 17 to the projecting toe of the sole 5 of the boot 6, the front surface of the sole 5 of the boot 6 having a slot 18 communicating with the holes 4 in the sole 5 which engage the free end of the spring 3 (FIGS. 8, 9, 10).

The ski binding operates as follows. The axes of the holes 4 and the rest pins 1 are brought into alignment. The spring 3 is pressed back so that the free end thereof gets out of the holes 4 of the sole 5 allowing the rest pins 1 to fully fit in the holes 4. To provide for automatic locking of the boot 6, it is practicable to make a skew at the top of each pin 1 which, on entering the hole 4 of the sole 5, pushes back the free end of the spring 3 permitting the pin 1 to fully fit in the hole 4 of the sole 5. In the working position the end of the spring 3 engages an aperture 19 in the pins 1.

Figure 11:
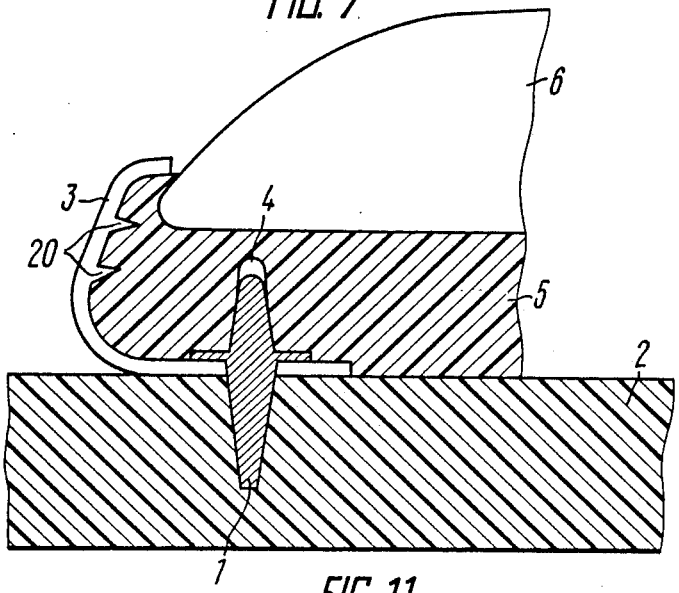
FIG. 11 shows the locking of the boot in the ski binding, wherein the stop is designed as tenons mounted on the spring surface facing the boot sole.

The spring 3 may be designed in such a way that its surface facing the front of the sole 5 of the boot 6 has one or more tenons 20 for contact with the front surface of the sole 5 of the boot 6 (FIG. 11).

The ski binding operates as follows. To align the axes of the rest pins 1 and corresponding holes 4 of the sole 5, it is necessary to bend the spring 3 with the tenons 20 towards the toe of the ski 2. After that the boot 6 is moved on the rest pins 1 till it gains contact with the surface of the ski 2. Then the spring 3 is released and while expanding it travels in the direction of the front surface of the sole 5, thereby pressing the tenons 20 to the front surface of the sole 5 of the boot 6.

INDUSTRIAL APPLICABILITY

The invention can be used to the best advantage both for sporting cross-country skis, when the skier uses both classical and skating strides.

I claim:

1. A ski binding comprising:

rest pins mounted on a ski;

holes in a toe portion of a sole of a boot for receiving corresponding rest pins thereon;

a bracket-shaped blade spring engaged with at least one rest pin, said spring restraining upward vertical movement of the toe portion of the boot;

a stop limiting upward vertical movement of the free end of said spring, said stop being constructed as a recess in a front surface of the toe portion of the sole of the boot.

2. A ski binding comprising:

rest pins mounted on a ski;

holes in a toe portion of a sole of a boot for receiving corresponding rest pins thereon;

a bracket-shaped blade spring having a bent configuration such that opposite ends of said blade spring are spaced from each other, said blade spring being restrained effectively only at opposite ends thereof so as to restrain upward vertical movement of the toe portion of the boot;

one end of said blade spring being engaged with a least one said rest pin;

the other end of said blade spring being engaged with the toe portion of the boot; and stop means engaged with the other end of the blade spring for limiting upward vertical movement of the other end of said spring.

3. A ski binding as claimed in claim 2, characterized in that the stop is designed as a V-shaped plate (10) mounted on a welt of the toe portion of sole (5) of the boot (6).

4. A ski binding as claimed in claim 2, characterized in that the stop is designed as a bail (12), one end thereof being hingeably attached to the ski (2), while the other end straddles the other end of the spring (3) from above.

5. A ski binding as claimed in claim 2, characterized in that the stop limiting the vertical movement is designed as a rigid bracket-shaped plate (13) mounted on the spring (3) so as to be able to move against it.

6. A ski binding as claimed in claim 2, characterized in that the stop is designed as a flange (14) disposed on the toe portion of sole (5) of the boot (6).

7. A ski binding as claimed in claim 2, characterized in that the stop is designed as at least one tenon (20) disposed on the surface of the spring (3), facing a front surface of the toe portion of sole (5) of the boot (6).

* * * * *